United States Patent [19]

Farrell

[11] 4,031,966

[45] June 28, 1977

[54] OPERATING AND SHOCK CYLINDER ASSEMBLY FOR VEHICLE UNDERBODY SCRAPERS AND THE LIKE

[75] Inventor: Eugene A. Farrell, Fishers Landing, N.Y.

[73] Assignee: Frink Sno-Plows, Clayton, N.Y.

[22] Filed: June 21, 1976

[21] Appl. No.: 698,037

[52] U.S. Cl. ..... 172/794; 172/265; 92/134; 60/417

[51] Int. Cl.² ..... E02F 3/12

[58] Field of Search ..... 172/261, 264, 265, 794; 92/134, 130 B, 60; 91/5; 60/413, 407, 417; 267/124, 126; 37/42 VL

[56] References Cited

UNITED STATES PATENTS

| | | | |
|---|---|---|---|
| 1,840,820 | 1/1932 | Price | 172/794 |
| 2,062,544 | 12/1936 | Weeks | 172/794 |
| 2,413,876 | 1/1947 | Lefler | 60/417 |
| 3,086,303 | 4/1963 | Weeks | 37/42 VL |
| 3,321,027 | 5/1967 | Johnson | 172/264 |
| 3,385,169 | 5/1968 | Hale | 92/60 |
| 3,420,273 | 1/1969 | Greer | 172/265 |
| 3,893,518 | 7/1975 | Farrell | 172/264 |

*Primary Examiner*—Richard J. Johnson
*Attorney, Agent, or Firm*—Bruns & Jenney

[57] ABSTRACT

An operating and shock cylinder assembly for vehicle mounted underbody scraper and grader blades, plows and the like. The assembly of cylinders operates with hydraulic fluid and air, both under pressure, to move the blade or plow between retracted and road engaging positions. It also permits the blade to trip or yield when it engages a fixed obstacle in the road after which the blade quickly returns to its road engaging position. The assembly includes a pair of coacting cylinders which are first charged with air under pressure after which one of the cylinders is charged with hydraulic fluid under pressure. The hydraulic charge forces all of the air into the other cylinder and further compresses it, and this air operates as a powerful spring force or load on a piston in the cylinder that is connected to the pivotally mounted blade. Under this condition, the blade is firmly but yieldably biased into road engaging position. When not in use, the blade can be retracted by exhausting the compressed air from the air loaded cylinder and moving its piston by hydraulic fluid to lift the blade out of contact with the road.

9 Claims, 1 Drawing Figure

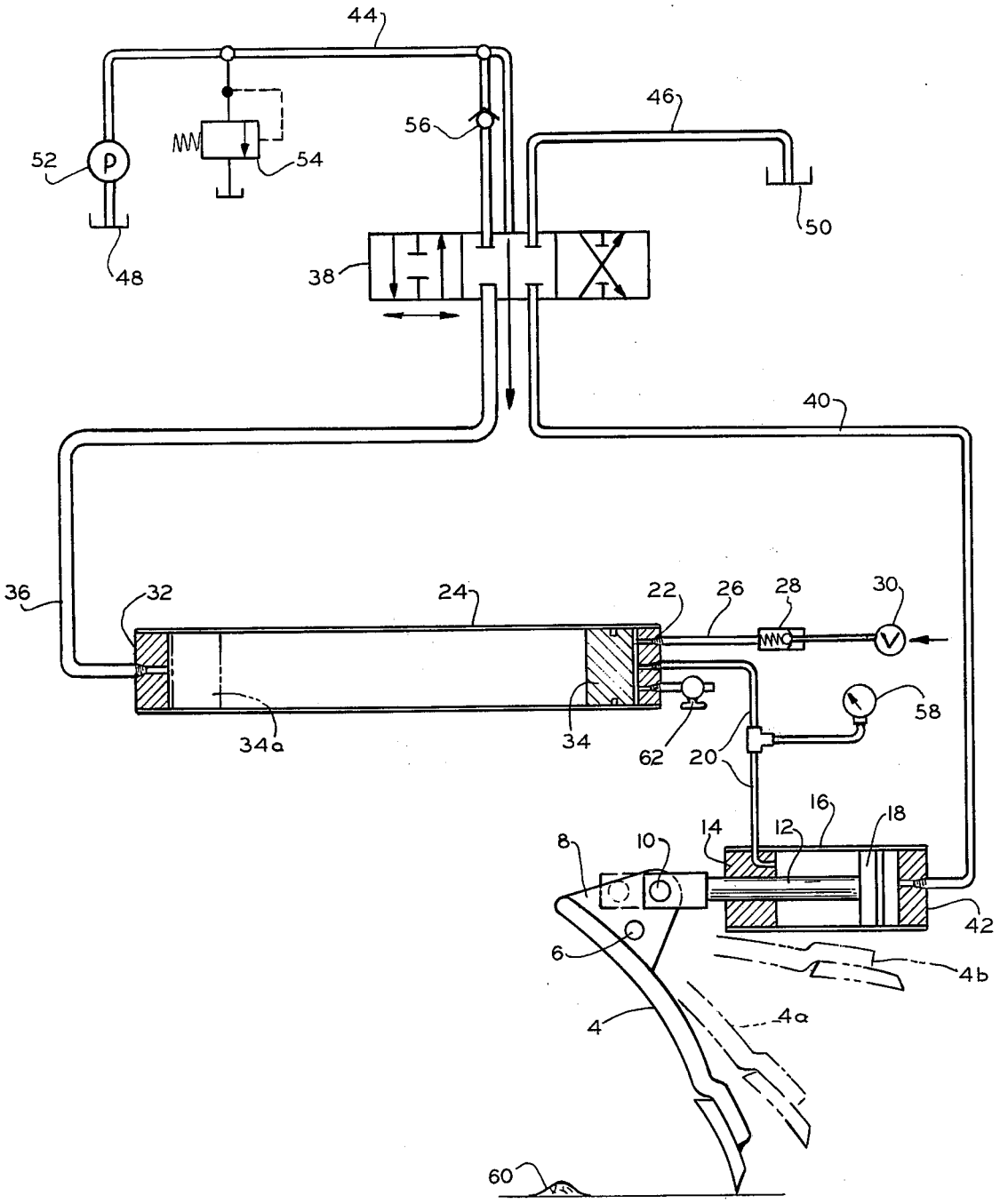
44
46
56
52
54
50
48
38
40
36
32
24
22
26
28
30
58
34a
34
62
20
16
18
14
12
8
10
42
6
4b
4
4a
60

OPERATING AND SHOCK CYLINDER ASSEMBLY FOR VEHICLE UNDERBODY SCRAPERS AND THE LIKE

BACKGROUND OF THE INVENTION

This invention relates generally to earth working and snow removal equipment, and has particular reference to a novel operating and shock cylinder assembly for vehicle mounted scraper blades and the like.

Vehicle mounted underbody blades for scraping, grading and snow removal generally employ hydraulic cylinders for pivoting the blades between retracted and road engaging positions. Since the blades frequently encounter non-yielding obstacles, they must be provided with yield or trip means so that the blades or their associated mechanisms are not damaged. In the prior art, the blade yield means has most commonly consisted of compression spring assemblies positioned between the operating cylinders and blade.

A more compact and effective shock absorbing and tripping mechanism is disclosed in U.S. Pat. No. 3,893,518 granted July 8, 1975 to the applicant herein. In that patent, which represents the closest prior art known to the applicant, the spring means are incorporated in the interiors of the operating cylinders thereby saving space and obviating the need for locating the springs, along with their attachment and guide means, in an exposed position on the blades.

A problem has, however, been encountered with the mechanism disclosed in the patent cited which problem is human rather than mechanical. Thus, in the patented shock absorbing cylinders, it is possible to increase the oil pressure enough so that the springs in the cylinders become non-resilient solid masses and the cylinders lose all shock absorbing and tripping capabilities. Unfortunately, this has happened due to inadvertence or carelessness.

SUMMARY OF THE INVENTION

The operating and shock cylinder assembly of the present invention is an improvement over the prior art in that it is simpler, more flexible and more foolproof. Because it employs no mechanical springs, the assembly is not subject to the limitations that are imposed by the physical size of such springs. Briefly stated, the invention provides a cylinder assembly and control system that has operator controlled means for rotating the blade from the raised or retracted position to road engaging position and back again, and also provides that the blade engages the road under constant pressure but with resilient means for allowing automatic tripping of the blade when it encounters an obstacle in the road, the blade being automatically returned to road engaging position after passing the obstacle.

The assembly of the invention is essentially comprised of a compression cylinder, a double acting cylinder, a source of hydraulic fluid under pressure, a source of air under pressure and a double acting valve. The two cylinders, which are interconnected, are first charged with compressed air, the air in the double acting cylinder operating through its piston and rod to move the blade into road engaging position. The compressed air also moves a free floating piston in the compression cylinder from one end thereof to the other.

The compression cylinder is then charged with hydraulic fluid under more pressure than the air which moves the free floating piston toward the other end of the cylinder and forces the compressed air into the double acting cylinder, the air being further compressed by this action. The air in the double acting cylinder loads its piston so that the blade is firmly but yieldably held in its road engaging position, the blade being able to yield or trip upon hitting an obstacle which even further compresses the air in the cylinder and insures that the blade will quickly snap back into road engaging position after passing over the obstacle. When not in use, the blade can be retracted by exhausting the compressed air from the double acting cylinder and moving its piston by hydraulic fluid to retract the blade.

BRIEF DESCRIPTION OF THE DRAWINGS

The single FIGURE of the drawings is a schematic diagram of an operating and shock cylinder assembly embodying the invention.

DESCRIPTION OF THE PREFERRED EMBODIMENT

Having reference now to the drawing, 4 indicates a scraper or grader or plow blade of the type that is adapted to be mounted beneath a truck, essentially as described in U.S. Pat. No. 3,893,518, supra. The blade 4 is pivotable about a fixed axis 6 supported by the truck underbody (not shown). The pivot axis 6 passes through a pair of operating ribs 8 (only one of which is shown) that project from the back of the blade adjacent its upper edge.

Each operating rib 8 is connected at 10 to a rod 12 which passes in an airtight manner through one end 14 of a double acting cylinder 16, only one of which is shown. At its inner end, rod 12 is connected to a piston 18. The end 14 of the cylinder 16 is connected by a suitable conduit 20 to one end 22 of a compression cylinder 24. The end 22 of cylinder 24 is also connected by a conduit 26 to the truck's sealed air supply (not shown), the conduit having therein a check valve 28 and a manually operated on-off valve 30.

The other end 32 of cylinder 24, which has a free floating piston 34 therein, is connected by a conduit 36 to a three position, double acting control valve 38. This valve is manually controlled by the operator of the truck. Valve 38 is also connected by a conduit 40 to the other end 42 of the double acting cylinder 16 and by conduits 44 and 46 to oil reservoirs 48 and 50, respectively. The two reservoirs can be one and the same.

The conduit 44 has therein a pump 52 for delivering fluid under pressure to the valve 38. The conduit also has 1500 P.S.I. relief valve 54 and a check valve 56 as indicated.

In describing the operation of the assembly, it will be assumed that piston 34 is initially positioned at the right end of cylinder 24 as shown, and that cylinder 24 is not charged with oil. The control valve 38 will be in its central or closed position as shown, there being no communication between any of the conduits 36, 40, 44 and 46.

At the outset, valve 30 in conduit 26 is opened and cylinder 24 is charged with air at 115 P.S.I. pressure from the truck's air supply. The air moves piston 34 to the left end of cylinder 24 as indicated by phantom lines at **34*a* and, at the same time, it enters cylinder 16 through conduit 20 and moves piston 18** to the right end of the cylinder as shown. The movement of piston 18 operates through rod 12 to pivot the blade 4 downwardly into road engaging position. Valve 30 is then closed.

After charging the cylinders with compressed air as described, control valve 38 is moved to the right to connect conduit 44 with conduit 36 and conduit 40 with conduit 46. This causes oil from reservoir 48 to be pumped through conduits 44 and 36 and enter the left end of compression cylinder 24. The cylinder is thus charged with oil at sufficient pressure causing the piston 34 to move back toward the right end of the cylinder.

The return movement of piston 34 forces the compressed air that occupied cylinder 24 into the double acting cylinder 16 through the conduit 20, reverse flow of the air through conduit 26 being prevented by check valve 28. The air within cylinder 16 is thus further compressed and in this connection it should be noted that in the embodiment of the invention shown, the volume of cylinder 24 that is available for receiving fluids is approximately five times the volume of cylinder 16 that is available for receiving fluids. The air in cylinder 16 after charging cylinder 24 with oil under pressure is thus compressed up to five times more than its original 115 P.S.I. pressure so that it is exerting a pressure of up to approximately 575 P.S.I. on piston 18. A 2000 P.S.I. gage 58 is connected in conduit 20 for reading the air pressure in cylinder 16.

With cylinder 16 charged as just described, the compressed air therein operates as a powerful spring force or load on piston 18 whereby the blade 4 is firmly but yieldably biased into road engaging position under substantially constant pressure. When the blade encounters an obstacle such as a partially buried rock 60 or a projecting manhole, the compressed air in cylinder 16 permits the blade to pivot upwardly as indicated by phantom lines at 4*a* with the result that the blade is able to pass over the obstacle without damage. The upward movement of the blade, which is caused by its contacting the obstacle, operates through piston rod 12 to move piston 18 to the left causing the air in cylinder 16 to be even further compressed. This insures that the blade will quickly snap back into road engaging position after passing over the obstacle.

When not in use, the blade 4 can be retracted into a raised position as indicated by phantom lines at 4*b*. This is accomplished by shifting control valve 38 all the way to the left which connects conduit 36 with conduit 46 and conduit 44 with conduit 40. Oil from reservoir 48 is then pumped through conduits 44 and 40 to the right end of cylinder 16. This moves piston 18 to the left and forces the compressed air that was loading the piston out through conduit 20 and into cylinder 24.

The compressed air entering the right end of cylinder 24 moves piston 34 to the left end of the cylinder and this forces the oil that occupied it out through conduits 36 and 46 and into reservoir 50.

From the foregoing description it will be apparent that the invention provides an improved operating and shock cylinder assembly for vehicle mounted scraper blades that is particularly advantageous in its simplicity and flexibility and in the fact that it is substantially tamper proof. As will be understood by those familiar with the art, the invention may be embodied in other specific forms without departing from the spirit or essential characteristics thereof.

I claim:

1. An operating and shock cylinder assembly for a vehicle mounted scraper blade that is pivotable between retracted and road engaging positions, a first vehicle mounted cylinder having a free floating piston therein, a second vehicle mounted cylinder having a piston and a rod connected at one end to the piston, the rod passing through an end of the cylinder and being connected at its other end to the pivotable scraper blade, a multi-position control valve, means to deliver hydraulic fluid under pressure to the valve, means connecting the valve to one end of the first cylinder, means connecting the other end of the first cylinder to one end of the second cylinder, means also connecting said other end of the first cylinder to a source of air under pressure, and means to charge the first cylinder with air under pressure, said air charge causing the free floating piston to occupy a position adjacent the end of the cylinder connected to the valve, said air charge also causing the piston in the second cylinder to move to a position whereby the scraper blade is pivoted downwardly into road engaging position, said control valve being movable after the first cylinder has been charged with air to a position whereby hydraulic fluid under pressure is delivered to the first cylinder causing the free floating piston to move toward the end of the cylinder connected to the air source and second cylinder, said piston movement causing the air in the first cylinder to pass into the second cylinder and be further compressed, the compressed air in the second cylinder acting to firmly but yieldably bias the scraper blade into road engaging position.

2. An assembly as defined in claim 1 wherein the scraper blade is pivotable about a fixed pivot axis, the relationship between the pivot axis and the blade connection with the second cylinder piston rod being such that when the lower edge of the blade encounters a fixed obstacle in the road it will pivot upwardly to clear the obstacle, the upward movement of the blade edge further compressing the air in the second cylinder, the compressed air in the second cylinder operating to return the blade to road engaging position after the blade has passed beyond the obstacle.

3. An assembly as defined in claim 1 wherein the volume of the first cylinder that is available for receiving fluids is approximately five times the volume of the second cylinder that is available for receiving fluids.

4. An assembly as defined in claim 1 wherein the means connecting said other end of the first cylinder to a source of air under pressure includes a check valve that prevents the air with which the cylinder is charged from flowing back through the connecting means.

5. An assembly as defined in claim 1 together with means connecting the end of the second cylinder opposite that connected to the first cylinder to the valve, the control valve being movable to a position whereby hydraulic fluid under pressure is delivered to the second cylinder causing the piston therein to move to a position whereby the scraper blade is pivoted upwardly into retracted position, the compressed air in the second cylinder being returned to the first cylinder.

6. An operating and shock cylinder assembly for a vehicle mounted scraper blade that is pivotable between retracted and road engaging positions, a first vehicle mounted cylinder having a free floating piston therein, a second vehicle mounted cylinder, a piston in the second cylinder and a rod connected at one end to the piston, the rod extending outwardly through one end of the second cylinder and being connected at its other end to the pivotable scraper blade, a multi-position control valve, a source of hydraulic fluid, pump means for delivering fluid from the source to the valve under pressure, means connecting the valve to one end of the first cylinder, means connecting the other end of the first cylinder to one end of the second cylinder, means also connecting said other end of the first cylinder to a source of air under pressure, the last-named means including a check valve for permitting air to flow into but not out of the first cylinder through said means, means connecting the other end of the second cylinder to the control valve, and means to charge the first cylinder with air under pressure, said air charge causing the free floating piston in the first cylinder to occupy a position adjacent the end of the cylinder connected to the control valve, said air charge also passing through the means connecting the first and second cylinders and causing the piston in the latter to move to a position adjacent its end that is connected to the control valve whereby the scraper blade is pivoted downwardly into road engaging position, said control valve being movable after the cylinders have been charged with air to a position whereby hydraulic fluid under pressure is delivered to the first cylinder causing the free floating piston to move toward the end of the cylinder connected to the air source and second cylinder, said piston movement forcing the compressed air in the first cylinder to pass into the second cylinder and be further compressed, the compressed air in the second cylinder acting to firmly but yieldably bias the scraper blade into road engaging position.

7. An assembly as defined in claim 6 wherein the volume of the first cylinder that is available for receiving fluids is approximately five times the volume of the second cylinder that is available for receiving fluids.

8. An assembly as defined in claim 6 wherein the scraper blade is pivotable about a fixed pivot axis, the relationship between the pivot axis and the blade connection with the second cylinder piston rod being such that when the lower edge of the blade encounters a fixed obstacle in the road it will pivot upwardly to clear the obstacle, the upward movement of the blade edge further compressing the air in the second cylinder, the compressed air in the second cylinder operating to return the blade to road enaging position after the blade has passed beyond the obstacle.

9. An assembly as defined in claim 6 wherein the control valve is movable to a position whereby hydraulic fluid under pressure is delivered to the second cylinder causing the piston therein to move to a position whereby the scraper blade is pivoted upwardly into retracted position, the compressed air in the second cylinder being exhausted to the first cylinder during such movement.

* * * * *